US009688924B2

(12) United States Patent
Dalemat et al.

(10) Patent No.: US 9,688,924 B2
(45) **Date of Patent: *Jun. 27, 2017**

(54) PROCESS FOR THE PRODUCTION OF HYDROCARBON FLUIDS HAVING A LOW AROMATIC CONTENT

(75) Inventors: Francois Dalemat, Berville en Roumois (FR); Anne-Eline Gilles, Paris (FR); Gildas Morvan, Fontenay (FR)

(73) Assignee: Total Marketing Services, Puteaux (FR)

( * ) Notice: Subject to any disclaimer, the term of this patent is extended or adjusted under 35 U.S.C. 154(b) by 501 days.

This patent is subject to a terminal disclaimer.

(21) Appl. No.: 13/510,908

(22) PCT Filed: Nov. 19, 2010

(86) PCT No.: PCT/IB2010/002966

§ 371 (c)(1),
(2), (4) Date: May 18, 2012

(87) PCT Pub. No.: WO2011/061612

PCT Pub. Date: May 26, 2011

(65) Prior Publication Data

US 2012/0283492 A1 Nov. 8, 2012

(30) Foreign Application Priority Data

Nov. 20, 2009 (WO) ..... PCT/IB2009/056016

(51) Int. Cl.
*C10G 65/08* (2006.01)
*C10G 45/48* (2006.01)

(52) U.S. Cl.
CPC ..... *C10G 65/08* (2013.01); *C10G 45/48* (2013.01); *C10G 2300/1059* (2013.01); *C10G 2300/202* (2013.01); *C10G 2300/301* (2013.01); *C10G 2300/4006* (2013.01);
(Continued)

(58) Field of Classification Search
USPC ..... 585/270, 274, 276
See application file for complete search history.

(56) References Cited

U.S. PATENT DOCUMENTS

| | | | |
|---|---|---|---|
| 3,654,139 | A | 4/1972 | Winsor et al. |
| 3,755,143 | A | 8/1973 | Hosoi et al. |
| 3,767,562 | A | 10/1973 | Sze et al. |

(Continued)

FOREIGN PATENT DOCUMENTS

| | | | |
|---|---|---|---|
| EA | 006835 | B1 | 4/2006 |
| EP | 1447437 | A1 | 8/2004 |

(Continued)

OTHER PUBLICATIONS

Russian Examination Report for Russian Patent Application No. 2012/120280 with partial English-language translation.

*Primary Examiner* — Ellen McAvoy
(74) *Attorney, Agent, or Firm* — Marsh Fischmann & Breyfogle LLP

(57) ABSTRACT

The invention provides a process for hydrogenating a low-sulphur feed into very low sulphur and very low aromatic hydrocarbon fluids having a boiling range in the range of from 100 to 400° C. and a boiling range of not more than 80° C., comprising the step of catalytically hydrogenating said feed at a temperature from 80 to 180° C. and at a pressure from 60 to 160 bars.

31 Claims, 1 Drawing Sheet

(52) U.S. Cl.
CPC ..... *C10G 2300/4012* (2013.01); *C10G 2300/4018* (2013.01); *C10G 2300/4081* (2013.01); *C10G 2400/18* (2013.01)

(56) References Cited

U.S. PATENT DOCUMENTS

| | | | | |
|---|---|---|---|---|
| 4,036,734 | A | 7/1977 | Manne et al. | |
| 4,347,124 | A | 8/1982 | Shimoiizaka et al. | |
| 4,447,315 | A | 5/1984 | Lamb et al. | |
| 4,469,590 | A | 9/1984 | Schucker et al. | |
| 4,875,992 | A | 10/1989 | Hammer | |
| 5,498,810 | A | 3/1996 | Bogdan et al. | |
| 5,654,253 | A | 8/1997 | Hucul et al. | |
| 5,741,414 | A * | 4/1998 | Waku et al. | 208/89 |
| 5,954,941 | A | 9/1999 | Mercier et al. | |
| 6,835,301 | B1 * | 12/2004 | Ellis et al. | 208/89 |
| 6,855,245 | B1 * | 2/2005 | Reesink et al. | 208/144 |
| 6,923,904 | B1 * | 8/2005 | Plantenga et al. | 208/216 R |
| 7,090,766 | B2 * | 8/2006 | Johnson et al. | 208/210 |
| 7,229,548 | B2 * | 6/2007 | Riley et al. | 208/216 R |
| 7,311,814 | B2 * | 12/2007 | Guyomar | C10G 65/12 208/108 |
| 7,374,667 | B2 * | 5/2008 | Debuisschert et al. | 208/211 |
| 7,550,636 | B2 * | 6/2009 | Picard et al. | 585/258 |
| 7,824,541 | B2 * | 11/2010 | Bhan | 208/244 |
| 8,207,083 | B2 * | 6/2012 | Berben | B01J 23/78 502/251 |
| 8,282,815 | B2 * | 10/2012 | Bouchy et al. | 208/137 |
| 8,329,610 | B2 * | 12/2012 | Gao | B01J 23/85 208/111.3 |
| 8,652,321 | B2 * | 2/2014 | Debuisschert et al. | 208/57 |
| 9,315,742 | B2 * | 4/2016 | Aubry | C10G 45/44 |
| 2006/0009666 | A1 * | 1/2006 | Ramachandran et al. | 585/258 |
| 2006/0161031 | A1 * | 7/2006 | Gribschaw et al. | 585/24 |

FOREIGN PATENT DOCUMENTS

| | | | |
|---|---|---|---|
| EP | 1619232 | A1 | 1/2006 |
| GB | 834776 | | 5/1960 |
| GB | 1218920 | | 1/1971 |
| GB | 1282774 | | 7/1972 |
| GB | 1457861 | | 12/1976 |
| GB | 1471228 | | 4/1977 |
| SU | 386519 | | 11/1967 |
| WO | 99/47626 | | 9/1999 |
| WO | 01/83640 | A1 | 11/2001 |
| WO | 0206427 | | 1/2002 |
| WO | 03074634 | | 12/2003 |
| WO | 03074635 | | 12/2003 |
| WO | 2006078389 | | 7/2006 |
| WO | 2008133219 | | 11/2008 |
| WO | 2011/061716 | A2 | 5/2011 |

* cited by examiner

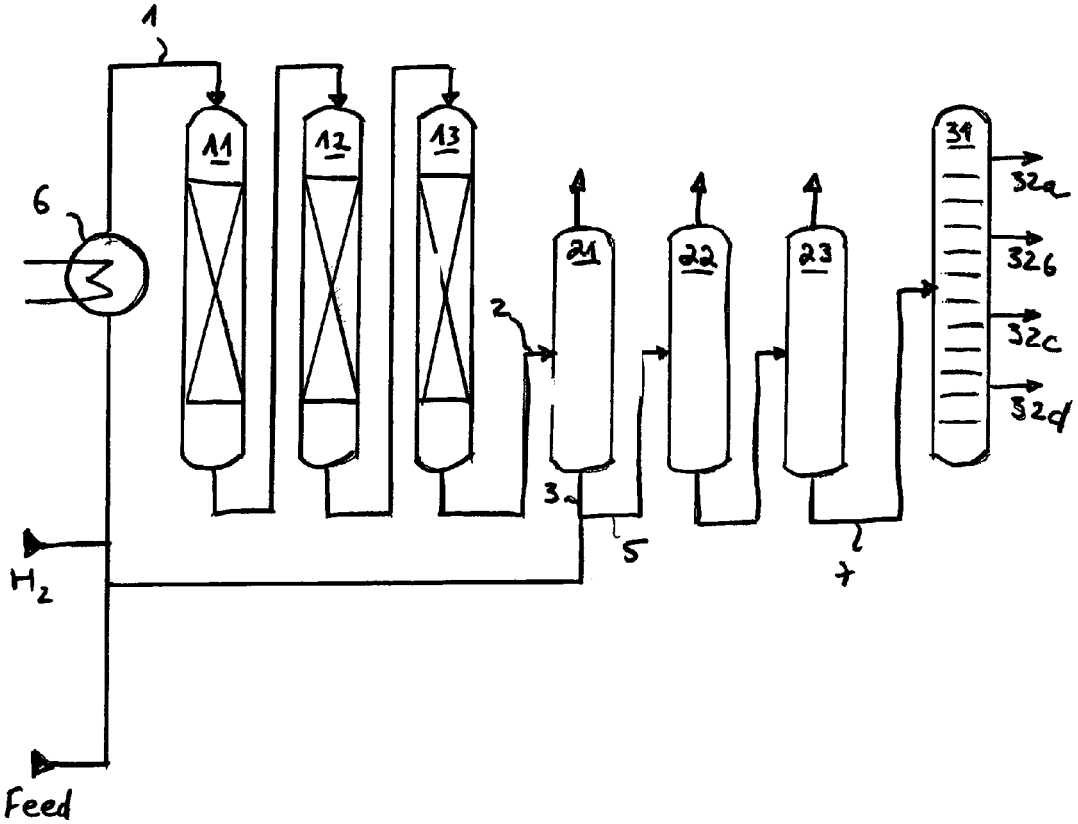
1
6
11
12
13
21
22
23
31
2
3
5
7
32a
32b
32c
32d
$H_2$
Feed

PROCESS FOR THE PRODUCTION OF HYDROCARBON FLUIDS HAVING A LOW AROMATIC CONTENT

FIELD OF THE INVENTION

The invention relates to the production of specific fluids having a narrow boiling range and having a very low aromatic content and their uses. The invention relates to hydrogenation conditions.

BACKGROUND ART

Hydrocarbon fluids find widespread use as solvents such as in adhesives, cleaning fluids, explosives solvents for decorative coatings and printing inks, light oils for use in applications such as metalworking or demoulding and industrial lubricants, and drilling fluids. The hydrocarbon fluids can also be used as extender oils in adhesives and sealant systems such as silicone sealants and as viscosity depressants in plasticised polyvinyl chloride formulations and as carrier in polymer formulation used as flocculants for example in water treatment, mining operations or paper manufacturing and also used as thickener for printing pastes. Hydrocarbon fluids may also be used as solvents in a wide variety of other applications such as chemical reactions.

The chemical nature and composition of hydrocarbon fluids varies considerably according to the use to which the fluid is to be put. Important properties of hydrocarbon fluids are the distillation range generally determined by ASTM D-86 or the ASTM D-1160 vacuum distillation technique used for heavier materials, flash point, density, Aniline Point as determined by ASTM D-611, aromatic content, sulphur content, viscosity, colour and refractive index. Fluids can be classified as paraffinic, isoparaffinic, dearomatised, naphthenic, non-dearomatised and aromatic.

These fluids tend to have narrow boiling point ranges as indicated by a narrow range between Initial Boiling Point (IBP) and Final Boiling Point (FBP) according to ASTM D-86. The Initial Boiling Point and the Final Boiling Point will be chosen according to the use to which the fluid is to be put. However, the use of the narrow cuts provides the benefit of a precise flash point which is important for safety reasons. The narrow cut also brings important fluid properties such as a better defined aniline point or solvency power then viscosity, and defined evaporation conditions for systems where drying is important, and finally better defined surface tension.

U.S. Pat. No. 4,036,734 discloses a process for converting aromatics into naphthenics. The process comprises two hydrogenation stages. The first hydrogenation stage is operated at a temperature from 204 to 315° C., a pressure from 6.9 to 103.5 bar, a liquid hourly space velocity of 0.5 to 10 $hr^{-1}$, and hydrogen treat rate of 0.034 to 0.34 $Nm^3$/liter of feed. The flow exiting the first stage comprises $H_2S$ which is disposed of and a solvent which is further hydrogenated in a second stage. The first stage operates under hydrodesulphurisation conditions. The second stage is operated at a temperature from 149 to 315° C., a pressure from 17.3 to 138 bar, a liquid hourly space velocity of 0.2 to 5 $hr^{-1}$, and a hydrogen treat rate of 0.08 to 0.51 $Nm^3$/liter of feed The final resulting fluid is said to have a boiling range which can be from 272° C. to 401° C., and aromatics contents up to 4.3% by weight, the lowest value reported being 0.4% by weight. The lowest value is obtained for the solvent having the lowest boiling range.

WO-A-03/074634 and WO-A-03/074635 are both directed to the production of fluids comprising at least 40% naphthenics and a narrow boiling range. In these two documents, the initial feed is a Vacuum Gas Oil (VGO), that is then subjected to hydrocracking. A typical VGO is disclosed as having the following properties:

Specific Gravity: 0.86-0.94;

ASTM D-1160 distillation: IBP 240-370° C., FBP 380-610° C. (here ASTM D-1160 is used due to the high Final Boiling Point);

Aromatics wt %: 1 ring from 13 to 27%, 2 rings from 10 to 20%, 3 rings from 7 to 11%, 4 rings from 6 to 12%, total from 40 to 65;

Naphthenes wt %: ring from 2 to 4%, 2 rings from 4 to 7%, 3 rings from 4 to 6%, 4 rings from 4 to 7%, total from 16 to 27;

Paraffins wt %: from 7 to 16%;

IsoParaffins wt %: from 8 to 20%;

Sulphur: from 1.75 to 3 wt % (as measured by ASTM D-2622 using X-Ray Fluorescence);

This VGO is then hydrocracked into a feedstock.

The feedstocks have low sulphur content, typically 1 to 15 ppm by weight. These feedstocks have also a low aromatic content, typically 3 to 30 wt % (this is said to be lower than the typical range of 15 to 40 wt % in conventional fluid manufacture).

It is indicated that the lower sulphur content can avoid or reduce the need for deep hydrodesulphurisation and also results in less deactivation of the hydrogenation catalyst when hydrogenation is used to produce dearomatised grades. The lower aromatic content also diminishes the hydrogenation severity required when producing dearomatised grades thus allowing the debottlenecking of existing hydrogenation units or allowing lower reactor volumes for new units.

It is further indicated that the resulting products have a high naphthenics content, typically at least 40%, preferably at least 60%.

Hydrogenation of the hydrocracked VGO is said to be operated at a temperature of 200° C., a pressure of 27 bar, a liquid hourly space velocity of 1 $hr^{-1}$, and a treat rate of 200 $Nm^3$/liter of feed.

While these two documents indicate that the final product has a very low content in aromatics, the fact is that high boiling products still contain a high amount of aromatics. The product having a boiling range of 237° C. to 287° C. is said to contain 42 ppm of aromatics. The three other products having higher boiling ranges (308° C.-342° C., 305° C.-364° C. and 312° C.-366° C.) have aromatics contents of about 2000 ppm.

Thus, the production of fluids having high boiling ranges, typically with an Initial Boiling Point above 300° C., together with very low aromatics content, typically below 100 ppm, is still not taught in the prior art.

EP1447437 discloses a process in which a first stream of hydrocarbons having an aromatics content of at least 70% is subjected to hydrodesulphurization so as to obtain a first stream with a sulphur content of less than 50 ppm, and step of hydrogenation. In this process, the first stream is said to have a distillation interval of 145-260° C., and the example provides for 142-234° C. It is also indicated that the hydrogenated stream can be fractionated, e.g. in light cuts of 100-205° C., middle cuts of 170-270° C. and heavy cuts of 200-400° C. Yet, in the sole example, there is no fractionation taking place. It is suggested in this EP1447437 the desulphuration and hydrogenation of a Light cycle oil fraction from the effluents of an FCC unit. It is however shown that even if the naphthenic content is high (86.5 wt %) which suggests good solvency, the aromatic content remains at 100 ppm.

WO01/083640 discloses that some specific cuts are gas oil cuts resulting from hydrocracking petroleum loads with the gas oil cuts undergoing a forced hydrogenation stage to eliminate aromatic compounds followed by fractionation.

The invention thus aims at providing a process for making products having a very low content in aromatics, typically below 100 ppm, and this even for products having an Initial Boiling Point above 300° C., especially for aliphatic (paraffinic and naphthenic) fluids.

SUMMARY OF THE INVENTION

The invention provides a process for hydrogenating a low-sulphur feed into very low sulphur and very low aromatic hydrocarbon fluids boiling in the range of from 100 to 400° C. and having a boiling range of not more than 80° C., comprising the step of catalytically hydrogenating said feed at a temperature from 80 to 180° C. and at a pressure from 60 to 160 bars.

According to one embodiment, the fluids contain less than 100 ppm aromatics, preferably less than 50 ppm, and more preferably less than 30 ppm.

According to one embodiment, the fluids have a boiling range in the range 150 to 400° C., preferably from 200 to 400° C.

According to one embodiment, the fluids have a boiling range below 75° C. and preferably between 40 and 50° C.

According to one embodiment, the fluids have a sulphur content of less than 5 ppm, preferably less than 3 ppm, most preferably less than 0.5 ppm.

According to one embodiment, the liquid hourly space velocity (LSHV) is from 0.2 to 5 $hr^{-1}$.

According to one embodiment, wherein the treat rate is from 100 to 300 $Nm^3$/ton of feed.

A preferred catalyst contains nickel; more preferably the catalyst is a nickel supported catalyst.

According to one embodiment, the catalyst comprises nickel supported on alumina carrier having specific surface area varying between 100 and 250 $m^2/g$ of catalyst, preferably between 150 and 200 $m^2/g$.

According to one embodiment, the process comprises three hydrogenation stages. The amount of catalyst in the three hydrogenation stages can be according to the scheme 0.05-0.5/0.10-0.70/0.25-0.85, for example 0.07-0.25/0.15-0.35/0.4-0.78 and most preferably 0.10-0.20/0.20-0.32/0.48-0.70. In one embodiment, the first stage is carried out in a trap reactor.

According to another embodiment, the process comprises two hydrogenation stages. The amount of catalyst in the two hydrogenation stages can be according to the scheme 0.05-0.5/0.5-0.95, preferably 0.07-0.4/0.6-0.93 and most preferably 0.10-0.20/0.80-0.90. In this embodiment, the first stage is carried out in a trap reactor.

According to one embodiment, the low-sulphur feed contains less than 15 ppm sulphur, preferably less than 8 ppm and more preferably less than 5 ppm. According to one embodiment, the low-sulphur feed contains less than 70% aromatics, preferably less than 30%.

According to one embodiment, the low-sulphur feed contains more than 20% aromatics, preferably more than 30%.

According to one embodiment, the low-sulphur feed is hydrocracked vacuum gas oil, optionally in admixture with FCC effluents and/or hydrotreated atmospheric distillate.

According to one embodiment, the process further comprises a separation stage, whereby unreacted hydrogen is recovered and a stream of hydrogenated product is recovered, and preferably recycled to the inlet of the process. The unreacted hydrogen can be recycled at least in part, to the inlet of the process. The stream of hydrogenated product can be recycled at least in part, to the inlet of the process. The separation stage can comprise three separators staged according to decreasing pressure. The pressure in the last separator can be about atmospheric pressure.

According to one embodiment, the process further comprises a step of prefractionation of the low-sulphur feed prior to hydrogenation, into fractions having a boiling range of less than 90° C., preferably less than 80° C.

According to one embodiment, the process further comprises a step of fractionation of the hydrogenated products into fluids of defined boiling ranges. The fractionation step can be carried out at a vacuum pressure from 10 to 50 mbars absolute.

Notably, the invention provides fluids having:

- a naphthenic content below 65% wt, especially; below 60% and even below 40%; and/or
- a polynaphthenic content below 40% wt, especially below 30% and even below 20%, and/or
- a paraffinic content above 30% wt, especially above 40% and even above 50%; and/or
- an isoparaffinic content above 25% wt, especially above 35%, and even above 45%.

The invention further provides the use of the fluids obtained by the process of the invention as drilling fluids, as industrial solvents, in coating fluids, in explosives, in concrete demoulding formulations, in adhesives, in printing inks, in metal working fluids, as cutting fluids, as rolling oils, as EDM fluids, rust preventive in industrial lubricants, as extender oils, in sealants or polymers formulation with silicone, as viscosity depressants in plasticised polyvinyl chloride formulations, in resins, as crop protection fluids, in pharmaceutical products, in paint compositions, in polymers used in water treatment, paper manufacturing or printing pastes and cleaning solvents.

DRAWINGS

The attached drawing is a schematic representation of a unit used in the invention.

DESCRIPTION OF EMBODIMENTS OF THE INVENTION

The invention provides specific hydrogenation conditions of low-sulphur feeds.

The low-sulphur feed typically contains less than 15 ppm of sulphur, but higher amounts can be processed, for example up to 30 ppm. Lower values are preferred. There is no limit for the lower value; generally the sulphur content is at least 1 ppm. Hence, a typical low-sulphur feed will comprise 1 to 15 ppm sulphur.

The feed can be of any type, including feed having a high aromatic content.

A typical feed will correspond to hydrocraked VGO, comprising typically 3 to 30 wt % aromatics. Higher aromatics content can be processed, up to 100%, like feed such as desulphurized light Cycle Oil (LCO).

A preferred feed is hydrocracked VGO.

Descriptions of hydrocracking processes may be found in Hydrocarbon Processing of November 1996 pages 124 to 128, hydrocracking science and technology, 1996, U.S. Pat. No. 4,347,124, U.S. Pat. No. 4,447,315, WO-A-99/47626

The feed can be of the light diesel type, heavy diesel type or jet type.

Before entering the hydrogenation unit, a prefractionation can take place. Having a more narrow boiling range entering the unit allows having a more narrow boiling range at the outlet. Typical boiling ranges of prefractionated cuts are 150° C. to 220° C., 220 to 310° C.

The feed is then hydrogenated.

Hydrogen that is used in the hydrogenation unit is typically a high purity hydrogen, e.g. with a purity of more than 99%, albeit other grades can be used.

Hydrogenation takes place is one or more reactor. The reactor can comprise one or more catalytic beds. Catalytic beds are usually fixed beds.

Hydrogenation takes place using a catalyst. Typical hydrogenation catalysts include but are not limited to: nickel, platinum, palladium, rhenium, rhodium, nickel tungstate, nickel molybdenum, molybdenum, cobalt molybdenate, nickel molybdenate on silica and/or alumina carriers or zeolithes. A preferred catalyst is Ni-based and supported on an alumina carrier, having a specific area varying between 100 and 250 $m^2/g$ of catalyst, preferably between 150 and 200 $m^2/g$.

The hydrogenation conditions are typically the following:

Pressure: 60 to 160 bars, preferably 100 to 150 bars, and most preferably 115 to 140 bars Temperature: 80 to 180° C., preferably 120 to 160° C. and most preferably 130 to 150° C.

Liquid hourly space velocity (LHSV): 0.2 to 5 $hr^{-1}$, preferably 0.5 to 3, and most preferably 0.8 to 1.5

Hydrogen treat rate: 100 to 300 $Nm^3$/ton of feed, preferably 150 to 250 and most preferably 160 to 200.

Using high pressure, low temperature hydrogenation conditions and an effective hydrogenation Ni-containing catalyst, together with high treat rates, in contrast to the prior art, offers several advantages, in peculiar no cracking occurs. Substantially no hydrodesulphurisation takes place: the sulphur compounds are rather trapped into or onto the catalyst rather than being discharged as $H_2S$ in the prior art process. In the conditions, the final product, even with high boiling ranges, typically above 300° C. or even above 320° C., still contains very low aromatics content, typically less than 100 ppm.

The process of the invention can be carried out in several stages. There can be two or three stages, preferably three stages.

The first stage will operate the sulphur trapping, hydrogenation of substantially all insaturates, and up to about 90% of hydrogenation of aromatics. The flow exiting from the first reactor contains substantially no sulphur. In the second stage the hydrogenation of the aromatics continues, and up to 99% of aromatics are hydrogenated. The third stage is a finishing stage, allowing aromatics contents as low as 100 ppm or even less such as below 50 ppm or even below 30 ppm, even for high boiling products.

The catalysts can be present in varying or substantially equal amounts in each reactor, e.g. for three reactors according to weight amounts of 0.05-0.5/0.10-0.70/0.25-0.85, preferably 0.07-0.25/0.15-0.35/0.4-0.78 and most preferably 0.10-0.20/0.20-0.32/0.48-0.70.

It is also possible to have two reactors instead of three.

The first stage will operate the sulphur trapping, hydrogenation of substantially all insaturates, and up to about 90% of hydrogenation of aromatics. The flow exiting from the first reactor contains substantially no sulphur. In the second stage the hydrogenation of the aromatics continues, and more than 99% of aromatics are hydrogenated, preferably allowing aromatics contents as low as 100 ppm or even less such as below 50 ppm or even below 30 ppm, even for high boiling products.

The catalysts can be present in varying or substantially equal amounts in each reactor, e.g. for two reactors according to weight amounts of 0.05-0.5/0.5-0.95, preferably 0.07-0.4/0.6-0.93 and most preferably 0.10-0.20/0.80-0.90.

It is also possible that the first reactor be made of twin reactors operated alternatively in a swing mode. This made be useful for catalyst charging and discharging: since the first reactor comprises the catalyst that is poisoned first (substantially all the sulphur is trapped in and/or on the catalyst) it should be changed often.

One reactor can used, in which two, three or more catalytic beds are installed.

It may be necessary to insert quenches on the recycle to cool effluents between the reactors or catalytic beds to control reaction temperatures and consequently hydrothermal equilibrium of the hydrogenation reaction. In a preferred embodiment, there is no such intermediate cooling or quenching.

In case the process makes use of 2 or 3 reactors, the first reactor will act as a sulphur trap, especially for benzo and di benzothiophens and their derivatives considered as the most refractory sulphur compounds present in refined hydrocarbons. This first reactor will thus trap substantially all the sulphur. The catalyst will thus be saturated very quickly and may be renewed from time to time. When regeneration or rejuvenation is not possible for such saturated catalyst the first reactor is considered as a sacrificial reactor which size and catalyst content depend on catalyst renewal frequency.

In an embodiment the resulting product and/or separated gas is/are at least partly recycled to the inlet of the hydrogenation stages. This dilution helps maintaining the exothermicity of the reaction within controlled limits, especially at the first stage. Recycling also allows heat-exchange before the reaction and also a better control of the temperature.

The stream exiting the hydrogenation unit contains the hydrogenated product and hydrogen. Flash separators are used to separate effluents into gas, mainly remaining hydrogen, and liquids, mainly hydrogenated hydrocarbons. The process can be carried out using three flash separators, one of high pressure, one of medium pressure, and one of low pressure, very close to atmospheric pressure.

The hydrogen gas that is collected on top of the flash separators can be recycled to the inlet of the hydrogenation unit or at different levels in the hydrogenation units between the reactors.

Because the final separated product is at about atmospheric pressure, it is possible to feed directly the fractionation stage, which is preferably carried out under vacuum pressure that is at about between 10 to 50 mbars, preferably about 30 mbars.

The fractionation stage can be operated such that various hydrocarbon fluids can be withdrawn simultaneously from the fractionation column, and the boiling range of which can be predetermined.

The hydrogenation reactors, the separators and the fractionation unit can thus be connected directly, without having to use intermediate tanks, as is usually the case in the prior art documents. By adapting the feed, especially the initial and final boiling points of the feed, it is possible to produce directly, without intermediate storage tanks, the final products with the desired initial and final boiling points. Moreover, this integration of hydrogenation and fractionation allows an optimized thermal integration with reduced number of equipment and energy savings.

The process of the invention will be disclosed by reference to the enclosed drawing. The complete unit comprises an hydrogenation unit 10, a separation unit 20 and a fractionation unit 30.

The hydrogenation unit comprises here three reactors 11, 12 and 13, connected in series. The reacting feed enters reactor 11 through line 1, and will pass then the second and eventually third reactor. The reacted stream exits reactor 13 through line 2. It is possible to have part of the reacted product of line 2 recycled to the inlet of the hydrogenation reactors, but one will prefer the mode depicted in the drawing. Line 2 enters high pressure separator 21, and exits through line 3. Line 3 is divided into two lines, 4 and 5.

Line 4 contains the recycled stream. The recycled stream still comprises hydrogen. This is combined with the source of hydrogen and feed, and will eventually flow through line 1. A heat exchanger 6 is used to adjust the temperature of the mixture entering the hydrogenation unit.

The temperature in the reactors is typically about 150-160° C. and the pressure is typically about 140 bars while the liquid hourly space velocity is typically about 0.8 and the treat rate is typically about 100 to 180 $Nm^3$/ton of feed, depending on the feed quality.

The stream exiting the hydrogenation section 10 will enter the first flash separator, the stream out of the first separator is partly recycled and partly sent to the second separator. This recycle ratio is between 2 and 20 typically about 4 to about 5.

The first flash separator is a high pressure separator, operated at a pressure ranging e.g. from about 60 to about 160 bars, preferably from about 100 to about 150 bars, and especially at about 130-140 bars.

The second flash separator 22 is a medium pressure separator, operated at a pressure ranging e.g. from about 10 to about 40 bars, preferably from about 20 to about 30 bars, and especially at about 27 bars.

Then a third, low pressure separator 23 is used. This third separator is preferably operated at a pressure ranging e.g. from about 0.5 to 5 bars, preferably from about 0.8 to about 2 bars, and especially at about atmospheric pressure.

A flow of product free of hydrogen is withdrawn through line 7 and sent directly to the fractionation column.

The fractionation column 31 is preferably operated under vacuum pressure, such as about 30 mBars absolute. The temperature profile of the column is set depending of the boiling properties of the products to be recovered.

Different streams 32*a*, 32*b*, 32*c*, 32*d*, can be withdrawn from top to bottom of the column, including at lateral, intermediate, levels.

The final products are then sent to storage.

The fluids produced according to the invention possess outstanding properties, in terms of aniline point or solvency power, molecular weight, vapour pressure, viscosity, defined evaporation conditions for systems where drying is important, and defined surface tension.

The fluids produced according to the invention also present an enhanced safety, due to the very low aromatics content, less than 100 ppm, typically less than 50 ppm, and preferably less than 30 ppm. This makes them suitable for use in crop protection fluids as well as pharmacological products. This is especially useful for high boiling products, typically products boiling in the range 300-400° C., preferably 320-380° C.

The boiling range of the final product is preferably not more than 75° C., preferably not more than 65° C., more preferably not more than 50° C.

The fluids of the present invention also have an extremely low sulphur content less than 0.5 ppm, at level too low to be detected by the usual low-sulphur analyzers.

The fluids produced by the present invention have a variety of uses for example in drilling fluids, in industrial solvents, in paints composition, in explosives, in printing inks and in metal working fluids, such as cutting fluids, EDM (electro discharge machining) fluids, rust preventives, coating fluids and aluminium rolling oils, and in concrete demoulding formulations. They can also be used in industrial lubricants such as shock absorbers, insulation oils, hydraulic oils, gear oils, turbine oils, textile oils and in transmission fluids such as automatic transmission fluids or manual gear box formulations. In all this foreseen uses, the Initial Boiling Point to Final Boiling Point range are selected according to the particular use and composition. The fluids are also useful as components in adhesives, sealants or polymer systems such as silicone sealant, modified silane polymers where they act as extender oils and as viscosity depressants for PVC pastes or Plastisol formulations.

The fluids produced according to the present invention may also be used as new and improved solvents, particularly as solvents for resins. The solvent-resin composition may comprise a resin component dissolved in the fluid, the fluid comprising 5 to 95% by total volume of the composition.

The fluids produced according to the present invention may be used in place of solvents currently used for inks, coatings and the like.

The fluids produced according to the present invention may also be used to dissolve resins such as: a) acrylic-thermoplastic; b) acrylic-thermosetting; c) chlorinated rubber; d) epoxy (either one or two part); e) hydrocarbon (e.g., olefins, terpene resins, rosin esters, petroleum resins, coumarone-indene, styrene-butadiene, styrene, methyl-styrene, vinyl-toluene, polychloroprene, polyamide, polyvinyl chloride and isobutylene); f) phenolic; g) polyester and alkyd; h) polyurethane and modified polyurethane; i) silicone and modified silicone (MS polymers); j) urea; and, k) vinyl polymers and polyvinyl acetate.

Examples of the type of specific applications for which the fluids and fluid-resin blends may be used include coatings, cleaning compositions and inks. For coatings the blend preferably has a high resin content, i.e., a resin content of 20% to 80% by volume. For inks, the blend preferably contains a lower concentration of the resin, i.e., 5%-30% by volume.

In yet another embodiment, various pigments or additives may be added.

The fluids produced by the present invention can be used as cleaning compositions for the removal of hydrocarbons The fluids may also be used in cleaning compositions such as for use in removing ink, more specifically in removing ink from printing.

In the offset printing industry it is important that ink can be removed quickly and thoroughly from the printing surface without harming the metal or rubber components of the printing machine. Further there is a tendency to require that the cleaning compositions are environmentally friendly in that they contain no or hardly any aromatic volatile organic compounds and/or halogen containing compounds. A further trend is that the compositions fulfil strict safety regulations. In order to fulfil the safety regulations, it is preferred that the compositions have a flash point of more than 62° C., more preferably a flash point of 90° C. or more. This makes them very safe for transportation, storage and use. The fluids produced according to the present invention have been found to give a good performance in that ink is readily removed while these requirements are met.

The fluids produced according to this invention are also useful as drilling fluids, such as a drilling fluid which has the fluid of this invention as a continuous oil phase. The fluid may also be used as a rate of penetration enhancer comprising a continuous aqueous phase containing the fluid produced according to this invention dispersed therein.

Fluids used for offshore or on-shore applications need to exhibit acceptable biodegradability, human, eco-toxicity, eco-accumulation and lack of visual sheen credentials for them to be considered as candidate fluids for the manufacturer of drilling fluids. In addition, fluids used in drilling uses need to possess acceptable physical attributes. These generally include a viscosity of less than 4.0 $mm^2/s$ at 40° C., a flash value of less than 100° C. and, for cold weather applications, a pour point at −40° C. or lower. These properties have typically been only attainable through the use of expensive synthetic fluids such as hydrogenated polyalphaolefins, as well as unsaturated internal olefins and linear alpha-olefins and esters. The properties can however be obtained in some fluids produced according to the present invention Drilling fluids may be classified as either water-based or oil-based, depending upon whether the continuous phase of the fluid is mainly oil or mainly water. Water-based fluids may however contain oil and oil-based fluids may contain water and the fluids produced according to this invention are particularly useful as the oil phase.

Typically preferred ASTM D-86 boiling ranges for the uses of the fluids are that printing ink solvents (sometimes known as distillates) have boiling ranges in the ranges 235° C. to 265° C., 260° C. to 290° C., 280° C. to 315° C. and 300° C. to 355° C. Fluids preferred for use as drilling fluids have boiling ranges in the ranges 195° C. to 240° C., 235° C. to 265° C. and 260° C. to 290° C. Fluids preferred for explosives, concrete demoulding, industrial lubricants, transmission fluids and metal working fluids having boiling ranges in the ranges 185° C. to 215° C., 195° C. to 240° C., 235° C. to 365° C., 260° C. to 290° C., 280° C. to 325° C. and 300° C. to 360° C. Fluids preferred as extenders for sealants having boiling ranges in the ranges 195° C. to 240° C., 235° C. to 265° C., 260° C. to 290° C., 280° C. to 325° C. or 300° C. to 360° C. Fluids preferred as viscosity depressants for polyvinyl chloride plastisols have boiling ranges in the ranges 185° C. to 215° C., 195° C. to 240° C., 235° C. to 265° C., 260° C. to 290° C., 280° C. to 315° C. and 300° C. to 360° C.

Fluids preferred as carrier for polymeric composition used in water treatment, mining operation or printing pastes have boiling ranges in the ranges 185° C. to 215° C., 195° C. to 240° C., 235° C. to 265° C., 260° C. to 290° C., 280° C. to 315° C. and 300° C. to 360° C.

Fluids preferred for crop protection application have boiling ranges in intervals between 300 and 370° C., such fluids being used in combination with hydrocarbon fluids such as isodewaxed hydrocarbons or any hydrocarbons having comparable properties such as viscosity.

For Pharmacological application, fluids have boiling ranges in intervals between 275° C. to 330° C., 290° C. to 380° C. and 300 to 370° C.

For paint compositions and cleaning applications, the most preferred boiling range are in intervals 140 to 210° C., and 180 to 220° C. Fluids showing an initial boiling point above 250° C. and a final boiling point close to 330° C. or preferably close to 290° C. will be preferred for low VOC coatings formulations.

EXAMPLES

The following examples illustrate the invention without limiting it.

Example 1

The aim of the present example is to describe the preparation of hydrocarbon fluids according to the present invention and comparison with hydrocarbon fluids prepared according to the prior art such as those obtained by hydrogenation of hydrocracked vacuum distillate such as disclosed in patent applications WO03/074634 and/or WO03/074635.

Hydrocarbons fluids obtained according to this prior art were obtained by hydrocracking vacuum distillate (in the boiling range between 180° C. á 450° C., containing 45% in weight aromatics) under pressure of 142 à 148 bars within two reactors, at 378 and 354° C. respectively in presence of a catalyst. The hydrocracked vacuum distillate shows a sulphur content between 3 and 8 ppm and an aromatic content between 3 et 30% weight. The hydrocracked distillate is hydrogenated under pressure of 2700 kPa, at 200° C. with a liquid hourly space velocity (LHSV) of 1 $hour^{-1}$, the ratio hydrogen flow to liquid flow being equal to 200 $Nm^3/l$.

The dearomatized desulphurized distillate is fractionated into cuts Ti of intervals of boiling temperature of 65° C. The characteristics of these cuts are given in table 1 hereafter.

According to the present invention, a hydrocracked middle distillate having less than 1 ppm sulphur content and between 1 to 20% aromatics has been hydrogenated over a nickel hydrogenating catalyst under pressure of 105 bars, at a liquid hourly space velocity (LHSV) of 1 $h^{-1}$, and at a temperature between 155 and 160° C. and at a treat rate as above according to the invention through units and process disclosed here over within three reactors. Then the resulting hydrogenating desulphurized distillate is fractionated in cuts Di having boiling temperature range of less than 65° C. Characteristics of these cuts and real distillation yields are given in table 1 hereafter.

TABLE 1

| Characteristics | Units | Methods | T1 | T 2 | D1 | D2 | D3 | D4 | D5 |
|---|---|---|---|---|---|---|---|---|---|
| Distillation yield | | | 0-40% vol | 40-95% vol | 2% wt | 22% wt | 22% wt | 35% wt | 15% wt |
| density at 15° C. | kg/m3 | ASTM D4052 | 842 | 798 | 820 | 816 | 815 | 815 | 817 |
| Saybolt colour | | ASTM D56 | | 18 | 30 | 30 | 30 | 30 | 30 |
| sulphur ppm | ppm | ASTM D5453 | | | <<1 ppm | <<1 ppm | <<1 ppm | <<1 ppm | <<1 ppm |
| distillation IBP | ° C. | ASTM D86 | 237 | 305 | 200 | 230 | 250 | 275 | 300 |

TABLE 1-continued

| Characteristics | Units | Methods | T1 | T 2 | D1 | D2 | D3 | D4 | D5 |
|---|---|---|---|---|---|---|---|---|---|
| distillation FBP | ° C. | ASTM D86 | 287 | 364 | 237 | 265 | 285 | 320 | 350 |
| Flash pt | ° C. | ASTM D93 | 100 | 154 | 76 | 103 | 112 | 135 | 157 |
| Aniline pt | ° C. | ASTM D611 | 76 | 91 | 70.0 | 79 | 84 | 93 | 101 |
| viscosity at 40° C. | $mm^2/s$ | ASTM D445 | 3.0 | 7.7 | 1.7 | 2.4 | 2.8 | 4.1 | 6.0 |
| pour pt ° C. | ° C. | ASTM D97 | −40 | −6 | | −50 | −40 | −18 | −2 |
| aromatics | ppm | UV method | 420 | 19000 | <20 ppm | <20 ppm | <20 ppm | <50 ppm | <100 ppm |
| napthens | % wt | GC Method | 78.9 | 68.7 | 62.3 | 59.6 | 51.5 | 42.2 | 36.6 |
| mononaphtens | % wt | GC Method | 25.3 | 24.8 | 24.1 | 26.0 | 22.7 | 21.6 | 18.7 |
| polynapthens | % wt | GC Method | 53.6 | 43.9 | 38.2 | 33.6 | 28.8 | 20.7 | 17.9 |
| paraffins | % wt | GC Method | 21.1 | 29.3 | 37.7 | 40.5 | 48.5 | 57.8 | 63.4 |
| iso-paraffins | % wt | GC Method | 15.1 | 23.2 | 32.8 | 35.0 | 41.0 | 48.6 | 52.4 |
| n-paraffins | % wt | GC Method | 6.0 | 6.1 | 4.9 | 5.5 | 7.5 | 9.2 | 11.0 |

The comparison between products from the prior art with those of the present invention shows that:

- the products according to the invention are free of sulphur and present very low aromatic content
- the aromatic content of the products according to the invention is much lower than those of the prior art (less than 100 ppm instead of about 2000 ppm for the highest boiling ranges)
- the saybolt colour over 30, is required for many applications such as fluids for crop protection and pharmacological uses or mastics or sealants. It is not obtained with the products according to the prior art for the highest boiling ranges.

In addition, the compositions in terms of isoparaffins and naphthens are different.

Example 2

The aim of the present example is to describe the preparation of hydrocarbon fluids according to the present invention using two or three stages of hydrogenation.

Operative conditions for hydrogenation step is made within two or three stages are given in the following Table 2. The same feed has been treated according to the two possible process: it is a hydrocracked distillate having less than 1 ppm sulphur content and between 1 to 20% total aromatics content, and a distillation range between 210 and 350° C.

The table 2 also reports a ratio between the two embodiment, where the ratio represents the technical gain ratio, taking into account the catalyst replacement requirement and the numbers of hydrogenation unit shut down on a given period (in the example: five operating years). The ratio is expressed in % and is the sum of the % dedicated to the catalyst (where a high % is less valuable than a low %) and the % dedicated to the unit stops (again, where a high % is less valuable than a low %). The catalyst % expresses the replacement need (and indirectly the cost) and the unit stop % expresses the number of stops needed (and hence also indirectly the cost).

TABLE 2

| | % catalyst | Temperature ° C. | | pressure | Technical ratio Three stages/two stages | | |
|---|---|---|---|---|---|---|---|
| | Wt ratio | In | Out | Bars abs | Catalyst/ year | unit stop | Total |
| Two stages | | | | | | | |
| 1st reactor | 0.1 | 130 | 160 | 110 | 41% | 53% | 94% |
| 2nd reactor | 0.9 | 157 | 161 | 105 | 3% | 5% | 6% |

TABLE 2-continued

| | % catalyst | Temperature ° C. | | pressure | Technical ratio Three stages/two stages | | |
|---|---|---|---|---|---|---|---|
| | Wt ratio | In | Out | Bars abs | Catalyst/ year | unit stop | Total |
| Three stages | | | | | | | |
| 1st reactor | 0.15 | 130 | 155 | 106 | 38% | 35% | 73% |
| 2nd reactor | 0.3 | 155 | 158 | 105 | 3% | 3% | 6% |
| 3rd reactor | 0.55 | 158 | 156.5 | 103 | 0.5% | 0.5% | 1% |

According to the preceding table, it is clear that we may reduce the technical ratio by 20%. A similar economic gain is also achieved. by using three reactors instead of two, due to a reduction of catalyst replacement cost and reduced numbers of hydrogenation unit shut down on a given period (in the example: five operating years). Hence, the three stages process offers an advantage over the two stages process.

The invention claimed is:

1. Process for hydrogenating a low-sulphur feed containing less than 15 ppm sulphur, into very low sulphur and very low aromatic hydrocarbon fluids containing less than 5 ppm sulphur and having a content in aromatics below 100 ppm, boiling in the range of from 100 to 400° C. and having a boiling range of not more than 80° C., comprising the step of catalytically hydrogenating said feed at a temperature from 80 to 180° C. and at a pressure from 60 to 160 bars, in two or three hydrogenation stages with a nickel-containing catalyst.

2. Process of claim 1, wherein the fluids contain less than 50 ppm aromatics.

3. Process of claim 1, wherein the fluids are boiling in the range 150 to 400° C.

4. Process of claim 1, wherein the fluids have a boiling range below 75° C.

5. Process of claim 1, wherein the fluids have a sulphur content of less than 3 ppm sulphur.

6. Process of claim 1, wherein the liquid hourly space velocity (LSHV) is from 0.2 to 5 $hr^1$.

7. Process of claim 1, wherein the treat rate is from 100 to 300 $Nm^3$/ton of feed.

8. Process of claim 1, wherein the catalyst comprises a nickel supported catalyst.

9. Process of claim 1, wherein the temperature is below 180° C. and the pressure is above 60 bars.

10. Process of claim 1, comprising three hydrogenation stages.

11. Process of claim 10, wherein the amount of catalyst in the three hydrogenation stages is according to a weight percent scheme 5%-50%/10%-70%/25%-85%.

12. Process of claim 11, wherein the amount of catalyst in the three hydrogenation stages is according to a weight percent scheme 7% -25%/15%-35%/40%-78%.

13. Process of claim 1, comprising two hydrogenation stages.

14. Process of claim 13, wherein the amount of catalyst in the two stages, according to a weight percent scheme of 5%-50%/50%-95%.

15. Process of claim 14, wherein the amount of catalyst in the two stages according to a weight percent scheme of 7%-40%/60%-93%.

16. Process of claim 10, wherein the first stage is carried out in a trap reactor.

17. Process of claim 1, wherein the low-sulphur feed contains less than 8 ppm sulphur.

18. Process of claim 1, wherein the low-sulphur feed contains less than 70% aromatics.

19. Process of claim 1, wherein the low-sulphur feed contains more than 20% aromatics.

20. Process of claim 1, wherein the low-sulphur feed is hydrocracked vacuum gas oil, optionally in admixture with FCC effluents and/or hydrotreated atmospheric distillate.

21. Process of claim 1, further comprising a separation stage, whereby unreacted hydrogen is recovered and a stream of hydrogenated product is recovered.

22. Process of claim 21, wherein the unreacted hydrogen is recycled at least in part, to the inlet of the process.

23. Process of claim 21, wherein the stream of hydrogenated product is recycled at least in part, to the inlet of the process.

24. Process of claim 21, wherein the separation stage comprises three separators staged according to decreasing pressure.

25. Process of claim 24, wherein the pressure in the last separator is about atmospheric pressure.

26. Process of claim 1, further comprising a step of prefractionation of the low-sulphur feed prior to hydrogenation, into low-sulphur feed fractions having a boiling range of less than 90° C., then subjected to hydrogenation.

27. Process of claim 1, further comprising a step of fractionation of the hydrogenated products into fluids of defined boiling ranges.

28. Process of claim 27, wherein the fractionation step is carried out at a vacuum pressure from 10 to 50 mbars absolute.

29. Process of claim 1, wherein the fluids thus produced have:

a naphthenic content below 65% wt; and/or a polynaphthenic content below 40% wt and/or;

a paraffinic content above 30% wt; and/or an isoparaffinic content above 25% wt.

30. A product comprising a hydrocarbon fluid:

having an initial boiling point above 300° C., containing less than 5 ppm sulphur, having a content in aromatics below 100 ppm, and having a boiling range of not more than 80° C., prepared by the process of claim 1, wherein the product is selected from the group consisting of drilling fluids, industrial solvents, coating fluids, explosives, concrete demoulding formulations, adhesives, printing inks, metal working fluids, cutting fluids, rolling oils, EDM fluids, rust preventive in industrial lubricants, extender oils, sealants or polymers formulation with silicone, viscosity depressants in plasticised polyvinyl chloride formulations, resins, crop protection fluids, pharmaceutical products, paint compositions, polymers used in water treatment, paper manufacturing or printing pastes and cleaning solvents.

31. Process of claim 13, wherein a first said stage is carried out in a trap reactor.

* * * * *